United States Patent [19]

Ribeiro

[11] Patent Number: 5,054,510

[45] Date of Patent: Oct. 8, 1991

[54] SELECTIVE VALVE TO PASS FLUIDS

[75] Inventor: Marcos P. Ribeiro, Rio de Janeiro, Brazil

[73] Assignee: Petroleo Brasileiro S. A., Rio de Janeiro, Brazil

[21] Appl. No.: 449,213

[22] Filed: Dec. 12, 1989

[51] Int. Cl.[5] ..... F04B 21/00

[52] U.S. Cl. ..... 137/199; 417/435; 137/565

[58] Field of Search ..... 417/435; 137/199, 197, 137/565

[56] References Cited

U.S. PATENT DOCUMENTS

| | | | |
|---|---|---|---|
| 2,908,282 | 10/1959 | Maisch | 137/199 |
| 3,031,845 | 5/1962 | Ludwig | 137/199 X |
| 3,601,140 | 6/1969 | Hooper | 137/199 X |
| 3,861,471 | 1/1975 | Douglas | 417/435 X |
| 4,490,095 | 12/1984 | Soderberg | 417/435 X |
| 4,867,242 | 9/1989 | Hart | 417/443 X |

*Primary Examiner*—Alan Cohan

*Attorney, Agent, or Firm*—Sughrue, Mion, Zinn, Macpeak & Seas

[57] ABSTRACT

A selective valve to pass fluids consists of a body, and a housing, and is provided above and in the middle with a communicating passage for low surface tension and viscosity fluid, there being shells inside the body, seated upon the aforesaid housing, said shells consisting of a surface of a shape and a size that is controlled, a soft surface, and orifices, a sealing surface created in the control area of the shells where it meets the housing. There are below and in the middle, a communicating passage in touch with the fluid compressed by the pump. Preferred versions of the selective valve are provided with controlling blades and a ball and roughness controlling surfaces instead of the shells.

1 Claim, 2 Drawing Sheets

SELECTIVE VALVE TO PASS FLUIDS

FIELD OF THE INVENTION

This invention concerns selective valves to pass fluids used in the separating of low viscosity and low surface tension fluids, such as gas, for instance, inside fluid pumps in the compression of liquids in general.

The selective valves to pass fluid, as shown under this invention, are used to solve gas lock in sucker rod pumps, when a substantial quantity of gas fills the inside of the pump. Since gas is highly compressible the travelling valve does not open on the downstroke because the pressure of the column of fluid above is greater than the pressure of the gas compressed withing the pump.

BACKGROUND OF THE INVENTION

A major trouble to be overcome in the conventional types of subsurface oilfield pumps is technically known as a "gas lock", and happens when the incoming pressure in the tubing is kept up by the orifice outlet valve, or travelling valve, on the upstroke of the piston, and by the orifice inlet valve, or standing valve, on the downstroke of the piston. This downstroke of the travelling valve gives rise to pressure within the fluid, between the traveling and standing valves, and causes the traveling valve to open thus enabling fluid to pass through the traveling valve or orifice outlet valve. However, when operating in a well that is producing both oil and gas at the same time, the chamber placed between the travelling valve and the standing valve is often filled with gas, and because of the compressibility of the latter, the downstroke of the travelling valve may not create enough pressure in the chamber below the aforesaid valve to offset the pressure of the column of fluid standing above the valve, which means that therefore the travelling valve remains closed throughout the downstroke. Thus, the gas between the standing valve and the travelling valve only compresses and expands at every stroke of the piston, which leads to the pump operating defect known as "gas lock", a state of affairs which may go on indefinitely.

PI 8501271 of Mar. 19, 1985 concerns a system meant to provide an answer to the troubles referred to above, and consists of an elongated housing with upper and lower ends, a first valve fitted into the bottom end of the housing, a part to drive the travelling valve fitted in the upper end of the housing and placed so as to slide lengthways in relation to the housing, a rotating travelling valve fitted between the first valve and the part that drives the travelling valve, the travelling valve having upper and lower ends and a sealing surface against either end, a piston to compress fluids, lying between the first valve and the part that drives the travelling valve, and a means to rotate the travelling valve around its lengthwise axis, such rotating means being connected to the part that drives the travelling valve, and the travelling valve itself, whereby the lengthwise movement of the part that drives the travelling valve causes the travelling valve to rotate. The first valve is worked by changes in the pressure of the fluid, which take place inside the housing while the travelling valve and the part that works the travelling valve operate mechanically.

As regards performance in the foregoing system, note that gas locks, hydraulic chock and sealing defects caused by vibration of pump piston are avoided, though the same does not apply to wear, since there is no way of ensuring that particles of matter may not get into the travelling valve assembly, and if this does happen there may be serious trouble, not only as regards wear but also locking and breaking thereof, for if particles store in the joints this may be enough to bring about locking, and since operation is mechanical, considerable force is exerted upon the helical part, which is the most fragile in the system.

Positive displacement action pumps are also used. Throughout discharge the standing valve remains closed and the piston moves from its furthest position to its closest position as regards the standing valve. When this happens the piston tends to stay in the same place owing to the effect of friction between it and the pump body, as well as because of the effect of the counterpressure created between the travelling and the standing valves, as the pump moves towards the standing valve. At same time all the weight of the pump rods are bearing directly on the plug, forcing it to be pushed off the valve seat. This forced opening promptly prevents any gas or vapour lock from taking place.

When the valve opens the distance between the seat and the plug is limited by a stem that joins the plug to the connection. This distance is calculated beforehand in such a way as to enable the fluid to flow forward of the opening under less resistance.

As soon as the piston gets to the point closest to the standing valve it acts in the opposite direction, into its initial suction stroke. Again friction between the piston and the pump body tends to keep the piston back until the plug seals against its seat. This takes place when the relative speed of the fluids at either side of the valve is null, therefore the effect of any erosion upon sealing surfaces is considerably less.

When the travelling valve is closed the pressure between it and the standing valve reduces as the piston moves off from the standing valve, until it becomes lower than the pressure in the reservoir. When this happens the standing valve opens and lets fluid from the reservoir into the pump body. Finally when the piston gets to its point furthest away from the standing valve it moves in the opposite direction and the pumping cycle is repeated.

However a disadvantage of the aforesaid system is that particles of matter store and prevent operation from being ideal, since the relative movement of any fluid bearing particles of sand in suspension erodes the sealing portions of ball or piston valves (particularly in the case of the travelling valve concerned), because of rubbing by particles of silica in any kind of sand.

Another disadvantage is that it is difficult to make use of existing pistons, since not just any kind of piston may be used, and also there is the end cost of the equipment to consider.

SUMMARY OF THE INVENTION

This invention introduces the use of selective valves for fluids that allow only gas to pass and without any change in pump action. Such selective valves will act only when pressure is low inside the pump and when viscosity and surface tension are low, typical of gases in general.

Fluids within the pump (gas or liquid), and in the column, are to be separated by an opening or gap dynamically governed by the pressure inside the pump, the size of which will allow only fluids of low surface tension and viscosity to pass (such as gases).

Hence this invention is of a selective valve to pass fluids, for use with subsurface oilfield pumps, which valve goes into action only when pressure is low inside the pump, thereby enabling only fluids of low surface tension and viscosity to pass, and provided with separating means inside the pump and the column, which consists of openings or gaps dynamically governed by the pressure inside the pump.

In a first version of this invention the selective valve that passes the fluids consists of a body and a housing for the shells and there is a communicating passage, midway and at the top, for low surface tension and viscosity fluids, there being two shells within the selective valve, made of a flexible material, a sealing surface where the outside of the shell touches the housing, and in the middle thereof and below, a communicating passage in contact with the fluid compressed by the pump.

In a second version of this invention the selective valve to pass fluids consists of a body provided at its top and middle with a passage for low surface tension and viscosity fluids, and fitted with two governing blades, arranged in such a way as to become a governing surface or gap, the fluid compressed by the pump acting upon the outside surfaces of such governing blades, and provided below and in its middle with a passage from the high pressure fluid, and with seats alongside, and a non-return ball housed in said communicating passage.

In a third version of this invention the selective valve to pass the fluids consists of a body, a soft ball inside said body, an upper seat in the middle of said body with a surface touching the ball, of a shape suitable for governing purposes (for instance, of calculated roughness and shape), and a seat in the middle below with a sealing surface and a communicating passage next to the fluid compressed by the pump.

Other features and advantages of the selector valves for the flow of fluids, as under this invention, will now become more obvious from the detailed description that follows, together with the drawings under this specification.

DESCRIPTION OF THE PREFERRED EMBODIMENTS

As stated before, the purpose of the selective valve for the flow of fluids is to prevent gas locks in the pumping of fluids in general, which happens whenever there is a considerable quantity of gas inside the pump. Since gas is highly compressible the travelling valve does not open on the down stroke because the pressure of the column of fluid standing above is greater than the pressure of the gas compressed inside the pump.

Figure 1:
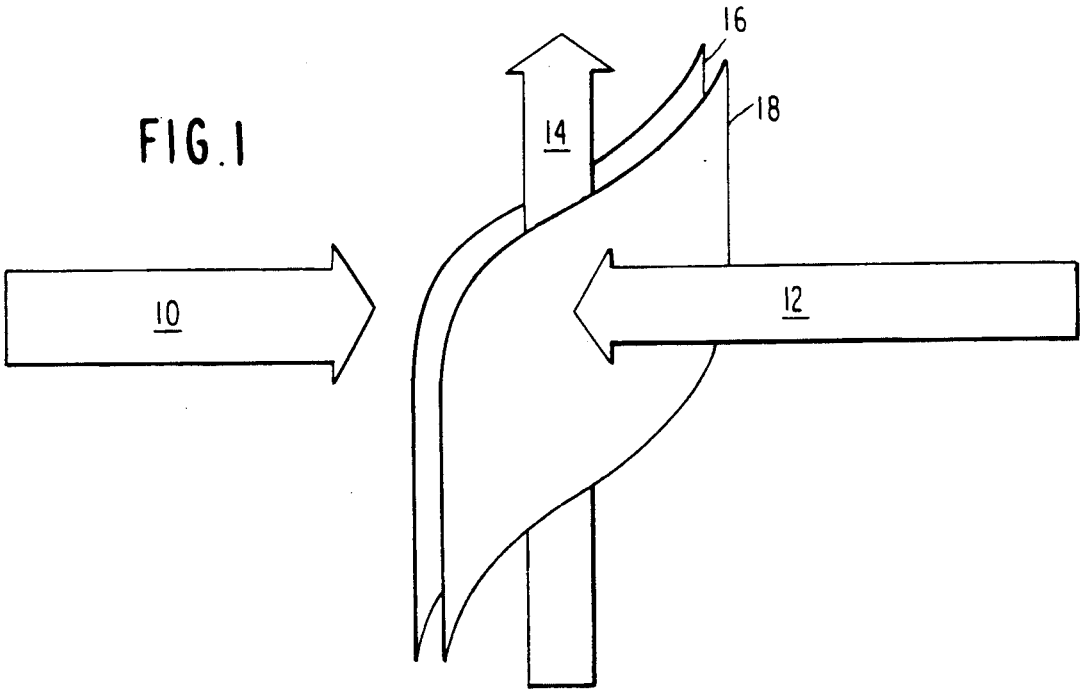
FIG. 1 is a schematic view showing the principle of operation of the mechanical system like that which takes place inside the selective valves of this invention.

One solution is to use a selective valve that lets only gas pass without any change in pumping action. The valve in question should act only when pressure inside the pump is low as well as viscosity and surface tension, which properties are usually to be met with in gases in general. The principle on which such valve operates is that the fluids inside the pump (gas or liquid) and those in the column should be separated by an opening or gap dynamically governed by the pressure inside the pump through which only very low surface tension and viscosity fluids (such as gas) may pass. FIG. 1 provides a better idea of such operation, arrows 10 and 12 pointing to pressure within the pump, and arrow 14 pointing to the controlled fluid (gas) space or opening, which space or opening lies between walls 16 and 18, the roughness and/or shape of which and the space inside being a function of the viscosity and surface tension of the gas.

Figure 2:
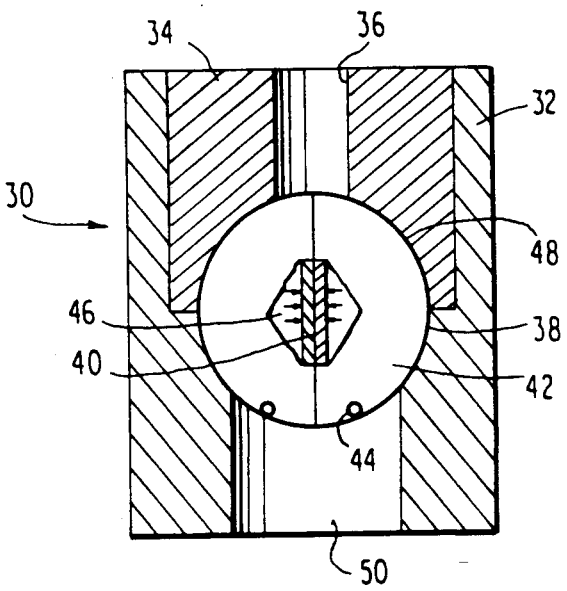
FIG. 2 is the view of a cross-section of the selective valve for the flow of fluids according to a first version of this invention.

In a first version of this invention the selective valve for the flow of fluids as shown in FIG. 2, bearing the general reference number, 30, consists of a body 32, and a housing, 34, for the shells, and provided at the top and in the middle with a communicating passage, 36, for the low surface tension and viscosity fluid, there being shells, 38, inside it, made of a flexible material, consisting of a surface of controlled roughness, 40, a soft surface, 42, and an opening, 44, for flow into the shell, the high pressure fluid acting within area 46, a sealing surface, 48, where the shell, 38, touches the housing, 34, and below and in the middle a communicating passage, 50, in touch with the fluid compressed by the pump.

Figure 3:
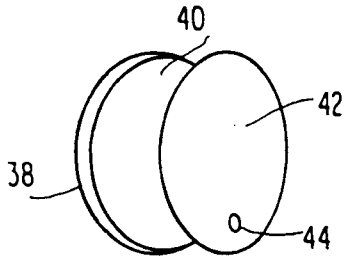
FIG. 3 is a front view of the shell used in the selective valve in FIG. 2.

As is to be inferred from FIGS. 2 and 3, the metal shells, 38, govern the flow of fluid by means of the pressure of the fluid that comes in at opening 44. Surface 48, where it touches upon the seat is soft, in order to ensure good sealing, and the contact walls between the shells should be rough, thick and of such a shape (twists or friezes) as to let in only gas.

Figure 4:
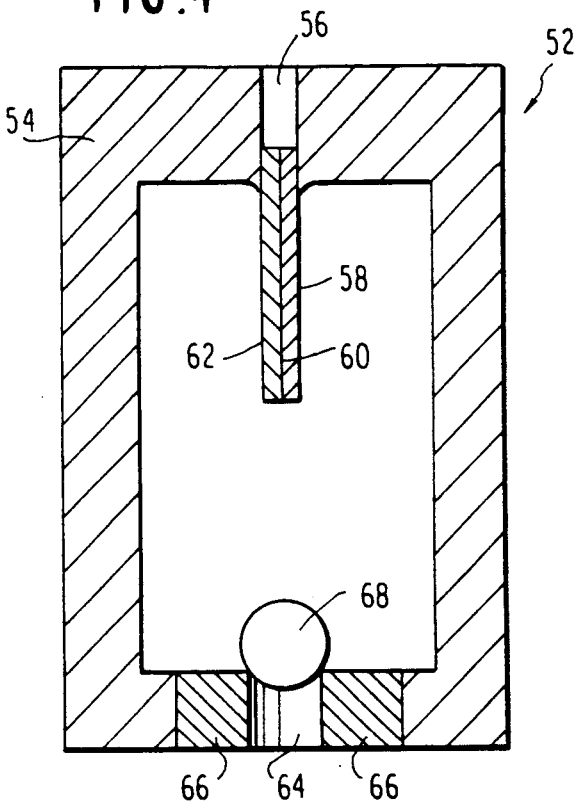
FIG. 4 is a cross-section view of the selective valve for the flow of fluids according to a second version of this invention.

In a second version of this invention the selective valve for the flow of fluids, as seen in FIG. 4, general design of which is given the number 52, consists of a body, 54, has an upper and middle communicating passage, 56, for low surface tension and viscosity fluid, and is fitted inside with control blades, 58, stretching from body, 54, of the valve, in communication with opening, 56, providing a control surface or gap, 60, the high pressure fluid acting upon the outer surfaces, 62 of the control blades, 58, and having inside and in the middle a communicating opening, 64, to the fluid compressed by the pump, there being seats, 66, alongside, and a non-return ball, 68, which is housed in said communicating opening, 64.

As is to be inferred from FIG. 4, the control blades, 58, have inside surfaces that are prepared in such a way that any fluid inside valve 52 compress the two blades, 58, and therefore governs the passage through the controle surface or gap, 60, thereby enabling low surface tension and viscosity fluid to pass.

Figure 5:
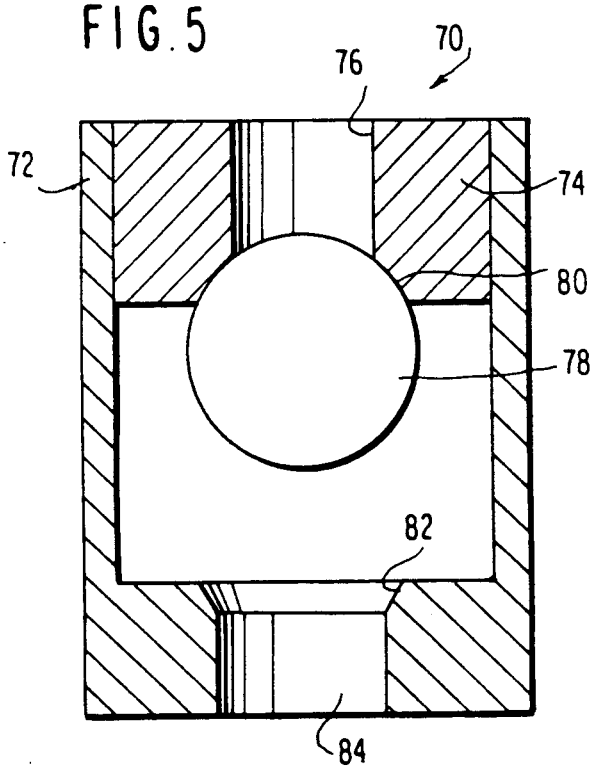
FIG. 5 is a cross-section view of the selective valve for the flow of fluids according to a third version of this invention.

Also, according to a third version of this invention, the selective valve for the flow of fluids, as seen in FIG. 5, general design of which is given the number 70, consists of a body, 72, and sealing seats, 74, and there are communicating passages, 76, at the top and in the middle, for the low surface tension and viscosity fluid, and inside there is a ball, 78, and rough control surfaces, 80, the fluid compressed by the pump acting upon the whole area of the ball which lies below the sealing seats, 74, and below and in the middle there is a sealing surface, 82 and a communicating passage, 84, in touch with the fluid compressed by the pump.

As is to be inferred from FIG. 5, the ball, 78, and respective control surfaces, 80, have a roughness and a shape which is governed. It should be pointed out that any different geometrical figure (plate, cone, etc.) may be employed instead of a ball, while any change made in such parts without making any change to the surface control idea suggested for the aforesaid selective valve, is to be regarded as a similar invention.

Figure 6:
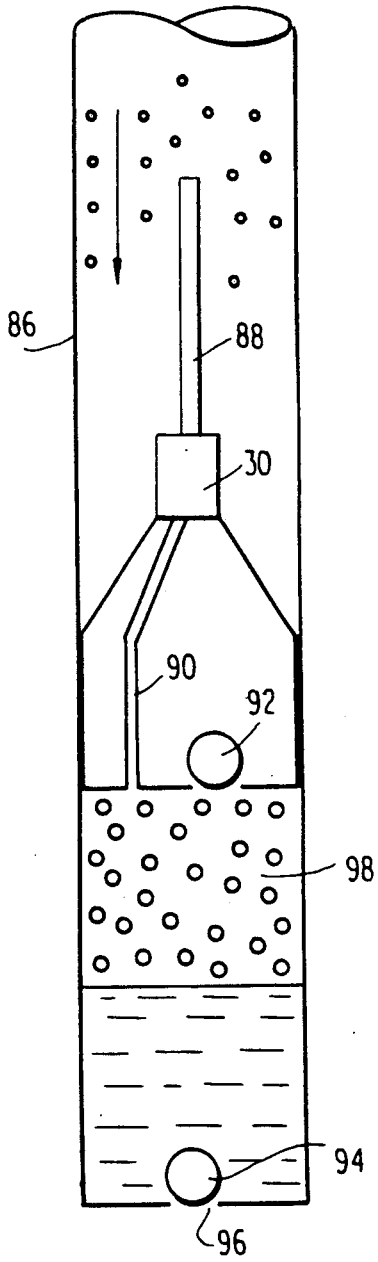
FIG. 6 is an enlarged cross-section view showing an example of the location of one of the preferred versions of selective valves inside a column.

FIG. 6 is an enlarged cross-section view providing an example of the location of one of the preferred versions of the selective valve of this invention, inside a column, showing column, 86, and inside it, the selective valve for fluids, 30, 52, 70, according to any of the versions referred to in this invention; selective valve, 30, from FIG. 6, being taken as an example, there being at the top a pumping rod, 88, and below, a communicating passage, 90, leading to the inside of the pump, a travelling valve, 92, a raised valve, 94, and pump suction, 96, and the inside of pump, 98, being shown as well.

As is to be inferred from FIG. 6, whenever there is liquid or little gas inside the pump, on the down stroke, the resulting pressure upon the controle walls will be high enough to prevent any fluid (even gas) from passing. Whenever there is a significant quantity of compressible fluid present (e.g., gas) inside the pump, the resulting pressure exerted upon the controlling walls will not be enough to prevent any very low viscosity and surface tension fluid from passing in the upper part of the pump (as in the case of gas). This happens because only a liquid with its very poor compressibility will quickly and strongly press upon the walls it touches, closing them up completely.

I claim:

1. A selective valve to pass fluids, for a subsurface oilfield pump within a column, said selective valve comprising a means inside the pump and the column, for separating purposes, said means having a predetermined surface roughness forming a fluid flow control gap, dynamically governed by the subsurface oilfield fluid pressure inside the pump, whereby said selective valve acts when fluid pressure is low inside the pump to enable low surface tension and viscosity fluids to flow through said fluid flow control gap, said selective valve consisting of a body provided above and in the middle with communicating passages for low surface tension and viscosity fluid, said passages being provided inside with controlling blades stretching from said body communicating with said passage, said blades having opposing faces defining a flow passage therebetween with at least one of said faces having said predetermined surface roughness and providing said flow control gap, the subsurface oilfield fluid acting upon the outside surfaces of said flow controlling blades, and said body being provided below and in the middle with a communicating passage in touch with said subsurface oilfield fluid compressed by the pump, and with seats in juxtaposition therewith, and a non-return ball housed within said communicating passage open to said subsurface oilfield fluid compressed by said pump for contact with said seats for closing off a fluid passage through said seats and about said non-return ball.

* * * * *